US012129760B2

(12) United States Patent
Yu et al.

(10) Patent No.: US 12,129,760 B2
(45) Date of Patent: Oct. 29, 2024

(54) MULTI-STAGE PRESSURE YIELDING AND ANTI-IMPACT DEVICE FOR ANCHORING SUPPORT

(71) Applicant: SHANDONG UNIVERSITY OF SCIENCE AND TECHNOLOGY, Shandong (CN)

(72) Inventors: Fenghai Yu, Qingdao (CN); Zhanling Li, Qingdao (CN); Yunliang Tan, Qingdao (CN); Tongbin Zhao, Qingdao (CN); Tucheng Li, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 18/690,263

(22) PCT Filed: Jun. 30, 2023

(86) PCT No.: PCT/CN2023/104408

§ 371 (c)(1),
(2) Date: Mar. 7, 2024

(65) Prior Publication Data

US 2024/0328317 A1 Oct. 3, 2024

(30) Foreign Application Priority Data

Mar. 28, 2023 (CN) ..... 202310314253.5

(51) Int. Cl.
*E21D 21/00* (2006.01)

(52) U.S. Cl.
CPC ..... *E21D 21/0033* (2013.01); *E21D 21/0086* (2013.01)

(58) Field of Classification Search
CPC ..... E21D 20/00; E21D 21/00; E21D 21/0026; E21D 21/0033; E21D 21/0086; E21D 21/0093
See application file for complete search history.

(56) References Cited

U.S. PATENT DOCUMENTS 4,407,610 A * 10/1983 Elders ..... E21D 21/0093 411/509
5,649,790 A * 7/1997 Mergen ..... E21D 21/004 405/259.1

(Continued)

FOREIGN PATENT DOCUMENTS

CN 203905979 U 10/2014
CN 206092041 U 4/2017

(Continued)

*Primary Examiner* — Benjamin F Fiorello
(74) *Attorney, Agent, or Firm* — Maschoff Brennan

(57) ABSTRACT

A multi-stage pressure yielding and anti-impact device for anchoring support is proposed, which includes an anti-impact component, a secondary pressure yielding component, and a primary pressure yielding component. The primary pressure yielding component and the secondary pressure yielding component each include an outer sleeve, an inner extrusion sleeve, and an expansion platform, and the expansion platform is arranged at a bottom end of the inner extrusion sleeve. A buffering and energy-absorbing material filling body is arranged between the outer sleeve and the inner extrusion sleeve. An outside diameter of the outer sleeve in the primary pressure yielding component is equal to that of a large-diameter end of the expansion platform in the secondary pressure yielding component, and the outer sleeve in the primary pressure yielding component is pressed against a bottom of the expansion platform in the secondary pressure yielding component.

12 Claims, 8 Drawing Sheets

(56) References Cited

U.S. PATENT DOCUMENTS

| | | | | |
|---|---|---|---|---|
| 6,402,433 | B1 | 6/2002 | Gillespie | |
| 6,561,721 | B2 * | 5/2003 | Lausch | E21D 21/0026 405/259.1 |
| 2006/0093438 | A1 * | 5/2006 | Fergusson | E21D 20/02 405/259.1 |
| 2011/0194902 | A1 * | 8/2011 | Mitri | E21D 21/006 405/259.5 |
| 2013/0115013 | A1 * | 5/2013 | He | E02D 5/74 405/259.3 |
| 2016/0168993 | A1 * | 6/2016 | Modlinski | E21D 21/0046 405/259.1 |

FOREIGN PATENT DOCUMENTS

| | | | |
|---|---|---|---|
| CN | 111456779 | A | 7/2020 |
| CN | 114934800 | A | 8/2022 |
| CN | 116335739 | A | 6/2023 |

* cited by examiner

MULTI-STAGE PRESSURE YIELDING AND ANTI-IMPACT DEVICE FOR ANCHORING SUPPORT

CROSS-REFERENCE TO RELATED APPLICATION

This application is a national stage application of International Patent Application No. PCT/CN2023/104408, filed Jun. 30, 2023, which claims priority of the Chinese Patent Application No. 202310314253.5, filed on Mar. 28, 2023, both of which are incorporated by references in their entities.

TECHNICAL FIELD

The present disclosure relates to the field of anchor bolt support in mine roadways, and in particular to a multi-stage pressure yielding and anti-impact device for anchoring support.

BACKGROUND

With the increase of mining depth, difficulties in controlling a surrounding rock of a roadway have become prominent due to the influence of high stress, intensive rheology, large deformation, and impact dynamic disasters. The concept of pressure yielding and anti-impact support is often used in the design of mine roadway support to ensure the stability of the surrounding rock of the mine roadway by releasing high stress and resisting dynamic load disturbance.

At present, bolt support is often used in mine roadways in China. A pressure yielding component, such as a pressure yielding ring or a special pressure yielding and anti-impact anchor bolt/anchor cable, is used to realize pressure yielding and anti-impact support. The pressure yielding component realizes pressure yielding through its deformation and failure, and has the problems of small deformation, low pressure yielding capacity, and poor compatibility with a commonly used anchor bolt/anchor cable. The special pressure yielding and anti-impact anchor bolt/anchor cable, for example, a normal group of large deformation anchor bolt/anchor cable proposed by Professor He Manchao, has good performance in pressure yielding, deformation yielding, and impact resisting, but reaming is required during use, and the cost is high, so it is not conducive to comprehensive promotion and use. Therefore, there is an urgent need for a pressure yielding and anti-impact device suitable for a commonly used anchor bolt/anchor cable. When the anchor bolt/anchor cable is under high working resistance, multi-stage pressure yielding is carried out based on the characteristics of the surrounding rock of the roadway to release the pressure of the surrounding rock, ensuring that the deformation of the surrounding rock is within an allowable range, and ensuring that an anchor bolt/anchor cable support body will not be damaged when the roadway is disturbed by a dynamic load such as impact, thus avoiding the occurrence of disasters such as rock burst and collapse in the roadway.

SUMMARY

In order to solve the above technical problems in prior art, a multi-stage pressure yielding and anti-impact device for anchoring support is proposed in the present disclosure, which can not only perform multi-stage pressure yielding by expanding a diameter of an inner extrusion sleeve to extrude buffering and energy-absorbing material filling bodies with different strengths when a surrounding rock deforms slowly, but also prevent impact under the influence of dynamic load disturbance. By combining the multi-stage pressure yielding with impact resisting, an effective control of the surrounding rock of a roadway is ensured.

To achieve the above objective, the following technical solution is proposed in the present disclosure: a multi-stage pressure yielding and anti-impact device for anchoring support includes an anti-impact component, a secondary pressure yielding component, and a primary pressure yielding component. The primary pressure yielding component, the secondary pressure yielding component, and the anti-impact component work in sequence, and a relationship among a bearing capacity $F_1$ of the primary pressure yielding component, a bearing capacity $F_2$ of the secondary pressure yielding component, and a bearing capacity $F_3$ of the anti-impact component is $F_3>F_2>F_1$. In specific applications, the bearing capacity of the above three components should be determined according to different engineering situations and the requirements of support materials. In general, a yield load of an anchor bolt/anchor cable is expressed as $[F_1]$, and a breaking load of the anchor bolt/anchor cable is expressed as $[F_2]$, according to the relationship among the bearing capacity of the three components, it is recommended that the bearing capacity $F_1$ of the primary pressure yielding component accounts for 50%~60% of $[F_1]$, the bearing capacity $F_2$ of the secondary pressure yielding component accounts for 70%~80% of $[F_1]$, and the bearing capacity $F_3$ of the anti-impact component accounts for 85%~95% of $[F_2]$. Through holes for the anchor bolt and the anchor cable to pass through are concentrically formed in axes of the anti-impact component, the secondary pressure yielding component, and the primary pressure yielding component, respectively.

The primary pressure yielding component and the secondary pressure yielding component each include an outer sleeve, an inner extrusion sleeve, and an expansion platform, and the expansion platform is arranged at a bottom end of the inner extrusion sleeve. A buffering and energy-absorbing material filling body is arranged between the outer sleeve and the inner extrusion sleeve. An outside diameter of the outer sleeve in the primary pressure yielding component is equal to that of a large-diameter end of the expansion platform in the secondary pressure yielding component, and the outer sleeve in the primary pressure yielding component is pressed against a bottom of the expansion platform in the secondary pressure yielding component.

The anti-impact component matches the outer sleeve of the secondary pressure yielding component in diameter, and the anti-impact component is welded with the secondary pressure yielding component to form an integrated component.

Preferably, the primary pressure yielding component includes a first outer sleeve of a cylindrical hollow structure; a first inner extrusion sleeve with an equal length to that of the first outer sleeve arranged on an inner side of the first outer sleeve; and a buffering and energy-absorbing material filled between the first outer sleeve and the first inner extrusion sleeve. The first inner extrusion sleeve in the first outer sleeve includes a first expansion part, an arc-shaped connection structure, and a first in-situ part from top to bottom. The first in-situ part is of a circular truncated cone-shaped hollow structure. The arc-shaped connection structure is configured to connect the first expansion part with the first in-situ part. The first expansion part is of a cylindrical hollow structure with an inside diameter equal to a diameter of the anchor cable.

A first expansion platform is installed on the first in-situ part of the first inner extrusion sleeve. A diameter of the first expansion part is equal to a diameter of a small-diameter end of the first expansion platform. The first expansion platform includes a cylindrical exposed end of a certain length. The exposed end can push the first expansion platform to slide in the first inner extrusion sleeve under force.

The first expansion platform is installed on the in-situ part of the first inner extrusion sleeve. The first expansion platform includes a cylindrical exposed end of a certain length. The exposed end can push the first expansion platform to slide in the first inner extrusion sleeve under force.

Preferably, the secondary pressure yielding component includes a second outer sleeve of a cylindrical hollow structure; a second inner extrusion sleeve with an equal length to that of the second outer sleeve arranged on an inner side of the second outer sleeve; and a buffering and energy-absorbing material filled between the second outer sleeve and the second inner extrusion sleeve. The second inner extrusion sleeve in the second outer sleeve includes a second expansion part, an arc-shaped connection structure, a second in-situ part, and an extended end from top to bottom. The second expansion part is of a cylindrical hollow structure which allows the anchor bolt and the anchor cable to pass through. The second in-situ part is of a circular truncated cone-shaped hollow structure. The arc-shaped connection structure is configured to connect the second expansion part with the second in-situ part. A second expansion platform matching the second in-situ part in shape is installed on the second in-situ part of the second inner extrusion sleeve. A top of the first outer sleeve extends into the second inner extrusion sleeve and is connected with the second inner extrusion sleeve.

Preferably, the anti-impact component includes two circular backing plates with a diameter equal to that of the second outer sleeve. A buffering and energy-absorbing material plate is glued between the two backing plates. The second outer sleeve is welded with a lower backing plate. A through hole is formed in a center of an integrated component formed by the two backing plates and the buffering and energy-absorbing material plate.

Preferably, the multi-stage pressure yielding and anti-impact device for anchoring support further includes a telescopic cylinder sleeved outside the primary pressure yielding component. The telescopic cylinder includes an upper telescopic cylinder and a lower telescopic cylinder. The upper telescopic cylinder is sleeved outside the first outer sleeve. A bottom of the upper telescopic cylinder is flush with a bottom of the first outer cylinder. The exposed end of the first expansion platform extends to a bottom of the lower telescopic cylinder.

Preferably, the buffering and energy-absorbing material is filled inside both the upper telescopic cylinder and the lower telescopic cylinder.

Preferably, the multi-stage pressure yielding and anti-impact device for anchoring support further includes pressure yielding identification marks. The pressure yielding identification marks are painted axially at bottoms of outer walls of the upper telescopic cylinder and the second outer sleeve with paints of different colors, and the marks are divided into different types according to colors of selected paints.

Preferably, an axial length of the mark is adjusted and determined based on characteristics of different on-site engineering projects and pressure yielding designs, and it is ensured that the axial length can be displayed clearly. It is generally recommended that the axial length of the mark is 3 mm~5 mm.

Compared with the prior art, the multi-stage pressure yielding and anti-impact device for anchoring support proposed in the present disclosure has the following beneficial effects:

(1) In the present disclosure, when the anchor bolt/anchor cable is under high working resistance, multi-stage pressure yielding is carried out so that the deformation of the surrounding rock is controlled by means of the anchor bolt and the anchor cable, and high stress of the surrounding rock is effectively released through the multi-stage pressure yielding. Moreover, the anti-impact component works under the influence of impact dynamic load disturbance, which effectively avoids the breakage and failure of the anchor bolt and the anchor cable caused by the dynamic load disturbance, realizes dual effects of multi-stage pressure yielding and impact prevention, and prevents the occurrence of collapse of a roadway roof and other phenomena caused by the breakage of the anchor bolt and the anchor cable.

(2) In the present disclosure, the pressure yielding and bearing capacities of the two components, that is, the secondary pressure yielding component and the primary pressure yielding component, are in a linear continuous increasing trend, and the pressure yielding capacities of the components can be well connected, so that the pressure yielding capacities are more stable.

(3) In the present disclosure, a pressure yielding state of the device is determined by comparing the colors displayed by the pressure yielding identification mark in an initial state and a working state, thereby a loading range of a support body is determined.

(4) In the present disclosure, a pressure yielding part and an anti-impact part are formed as a unified whole, which can be directly installed during use, and is simple and easy to operate.

BRIEF DESCRIPTION OF THE DRAWINGS

Drawings as a part of the description are used to provide a further understanding of the present disclosure, and are used for explaining the present disclosure together with embodiments of the present disclosure, but do not constitute a limitation to the present disclosure. In the drawings.

Figure 1:
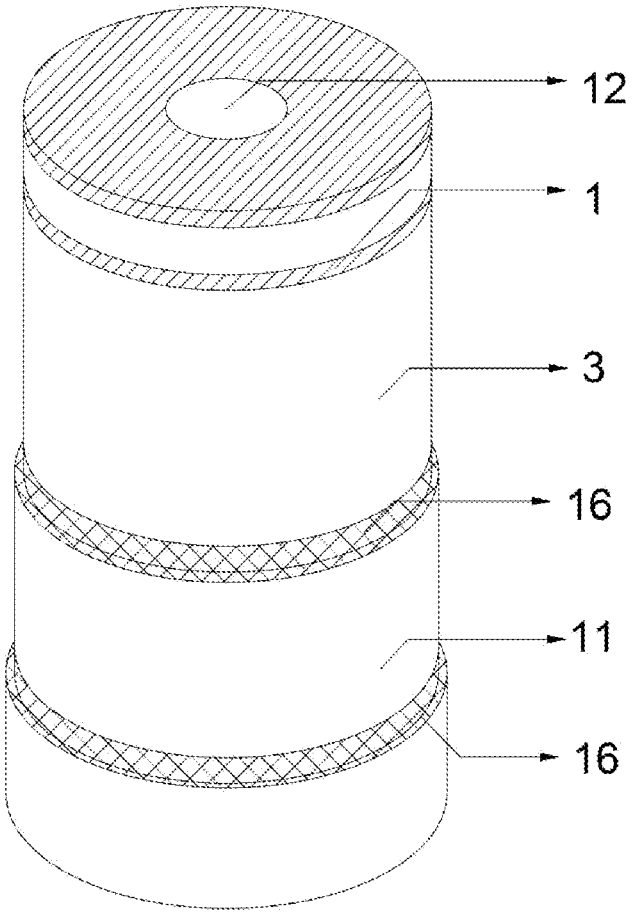
FIG. 1 is a schematic diagram of an overall structure of a multi-stage pressure yielding and anti-impact device for anchoring support disclosed in an embodiment of the present disclosure.

In the drawings: 1 backing plate; 2 buffering and energy-absorbing material plate; 3 second outer sleeve; 4 second inner extrusion sleeve; 41 second expansion part; 42 second in-situ part; 43 extended end; 5 buffering and energy-absorbing material; 6 first outer sleeve; 7 first inner extrusion sleeve; 71 first expansion part; 72 first in-situ part; 8 first expansion platform; 9 exposed end; 10 second expansion platform; 11 telescopic cylinder; 111 upper telescopic cylinder; 112 lower telescopic cylinder; 12 through hole; 13 tray; 14 anchor cable lockset; 15 anchor cable; and 16 pressure yielding identification mark.

DETAILED DESCRIPTION OF THE EMBODIMENTS

The technical solutions in the embodiments of the present disclosure are clearly and completely described below with reference to the drawings in the embodiments of the present disclosure. Apparently, the described embodiments are merely part rather than all of the embodiments of the present disclosure. In general, the components in the embodiments of the present disclosure, which are described and shown in the drawings herein, may be arranged and designed in a variety of different configurations. Therefore, the following detailed description of the embodiments of the present disclosure provided in the drawings is not intended to limit the scope of protection of the present disclosure, but only represents the selected embodiments of the present disclosure. Based on the embodiments of the present disclosure, all other embodiments obtained by those skilled in the art without any creative work fall within the protection scope of the present disclosure.

A multi-stage pressure yielding and anti-impact device for anchoring support proposed in an embodiment of the present disclosure is described in detail by taking the adaptation with an anchor cable as an example in combination with FIG. 1 to FIG. 11. The multi-stage pressure yielding and anti-impact device for anchoring support includes a primary pressure yielding component, a secondary pressure yielding component, and an anti-impact component sleeved on an anchor cable 15. The primary pressure yielding component, the secondary pressure yielding component, and the anti-impact component work in sequence. A relationship among a bearing capacity $F_1$ of the primary pressure yielding component, a bearing capacity $F_2$ of the secondary pressure yielding component, and a bearing capacity $F_3$ of the anti-impact component is $F_3>F_2>F_1$. A yield load of the anchor cable 15 is expressed as $[F_1]$, and a breaking load of the anchor cable 15 is expressed as $[F_2]$. According to the relationship among the bearing capacity of the three components, the bearing capacity $F_1$ of the primary pressure yielding component accounts for 50%~60% of $[F_1]$, that is, $F_1$=(50%~60%) $[F_1]$, the bearing capacity $F_2$ of the secondary pressure yielding component accounts for 70%~80% of $[F_1]$, that is, $F_2$=(70%~80%) $[F_1]$, and the bearing capacity $F_3$ of the anti-impact component accounts for 85%-95% of $[F_2]$, that is, $F_3$=(85%-95%) $[F_2]$. Through holes 12 for the anchor cable to pass through are concentrically formed in axes of the anti-impact component, the secondary pressure yielding component, and the primary pressure yielding component, respectively. The anchor cable 15 is anchored to a roof of a roadway after passing through the anti-impact component, the secondary pressure yielding component, and the primary pressure yielding component in sequence. When the stress of a surrounding rock acting on the device gradually increases to the designed bearing capacity of the above three components, the primary pressure yielding component, the secondary pressure yielding component, and the anti-impact component work in sequence to effectively control the deformation of the surrounding rock.

Each of the primary pressure yielding component and the secondary pressure yielding component includes an outer sleeve, an inner extrusion sleeve, and an expansion platform, and the expansion platform is arranged at a bottom end of the inner extrusion sleeve. A buffering and energy-absorbing material filling body is arranged between the outer sleeve and the inner extrusion sleeve. An outside diameter of the outer sleeve in the primary pressure yielding component is equal to that of a large-diameter end of the expansion platform in the secondary pressure yielding component, and the outer sleeve in the primary pressure yielding component is pressed against a bottom of the expansion platform in the secondary pressure yielding component. The anti-impact component matches the outer sleeve of the secondary pressure yielding component in diameter, and the anti-impact component is welded with the secondary pressure yielding component to form an integrated component. The above three components are connected to form a whole structure. When drilling is finished and the anchor cable 15 is anchored in the drilled hole, a tray 13, the whole structure of the above multi-stage pressure yielding and anti-impact device, and an anchor cable lockset 14 are sleeved on the exposed anchor cable 15 in sequence. The anchor cable 15 is tensioned by tensioning equipment, so that the tray 13, the whole structure of the above multi-stage pressure yielding and anti-impact device, and the anchor cable lockset 14 are tightly pressed against the roof.

By arranging components in different sizes and using buffering and energy-absorbing materials with different strengths, the pressure yielding and bearing capacities of the primary pressure yielding component and the secondary pressure yielding component are different. Specifically, the primary pressure yielding component in the present embodiment includes a first outer sleeve 6 of a cylindrical hollow structure; a first inner extrusion sleeve 7 with an equal length (i. e., an equal axial length) to that of the first outer sleeve 6 arranged on an inner side of the first outer sleeve 6; a buffering and energy-absorbing material 5 filled between the first outer sleeve 6 and the first inner extrusion sleeve 7. The first inner extrusion sleeve 7 in the first outer sleeve 6 includes a first expansion part 71, an arc-shaped connection structure, and a first in-situ part 72 from top to bottom. The first in-situ part 72 is of a circular truncated cone-shaped hollow structure. The arc-shaped connection structure is configured to connect the first expansion part 71 with the first in-situ part 72. The first expansion part 71 is of a cylindrical hollow structure with an inner diameter that is equal to a diameter of the anchor cable 15. A first expansion platform 8 is installed on the first in-situ part 71 of the first inner extrusion sleeve 7. A diameter of the first expansion part 71 is equal to a diameter of a small-diameter end of the first expansion platform 8. The first expansion platform 8 includes a cylindrical exposed end 9 of a certain length. The exposed end 9 can push the first expansion platform 8 to slide in the first inner extrusion sleeve 7 under force. In order to avoid the breakage and failure of the first expansion platform 8 due to its insufficient strength and hardness when sliding in the first inner extrusion sleeve 7 under force, both the strength and the hardness of the first expansion platform 8 are higher than those of the first inner extrusion sleeve 7. The bearing capacity of the first expansion platform 8 is greater than the bearing capacity $F_1$ of the primary pressure yielding component. In order to meet the above requirement, steel with a strength of $\sigma_1$ is selected to manufacture the first expansion platform 8. A gap between the first outer sleeve 6 and the first inner extrusion sleeve 7 is filled with the buffering and energy-absorbing material 5. A contact area between the buffering and energy-absorbing material 5 and the first inner extrusion sleeve 7 is expressed as $S_1$. In order to meet the requirement of the bearing capacity $F_1$ of the primary pressure yielding component and enable the primary pressure yielding component to preform pressure yielding when the applied force reaches $F_1$, the buffering and energy-absorbing material 5 with the strength of $\sigma_1'$ is selected as the buffering and energy-absorbing material filling body of the primary pressure yielding component based on $F=P\cdot S$.

During the operation of the device, in order to avoid the deformation of the first outer sleeve 6 during expansion and compression of the first inner extrusion sleeve 7 so as to maintain the stability of the support, steel with the strength of $\sigma_1''$ is selected to manufacture the first outer sleeve 6. Of course, the above-mentioned $\sigma_1$, $\sigma_1'$, and $\sigma_1''$ are only used for distinguishing the strengths of different materials of the components, and $\sigma_1''$ is the maximum, the $\sigma_1$ is the second, and $\sigma_1'$ is the minimum.

The secondary pressure yielding component includes a second outer sleeve 3 of a cylindrical hollow structure; a second inner extrusion sleeve 4 with an equal length (i. e., an equal axial length) to that of the second outer sleeve 3 arranged on an inner side of the second outer sleeve 3; a buffering and energy-absorbing material 5 filled between the second outer sleeve 3 and the second inner extrusion sleeve 4. The second inner extrusion sleeve 4 in the second outer sleeve 3 includes a second expansion part 41, an arc-shaped connection structure, a second in-situ part 42, and an extended end 43 from top to bottom. The second expansion part 41 is of a cylindrical hollow structure with an inner diameter that is the equal to the diameter of the anchor cable 15. The second in-situ part 42 is of a circular truncated cone-shaped hollow structure. The arc-shaped connection structure is configured to connect the second expansion part 41 with the second in-situ part 42. A second expansion platform 10 is installed on the second in-situ part 42 of the second inner extrusion sleeve 4. A top of the first outer sleeve 6 extends into the second inner extrusion sleeve 4 and is connected with the second inner extrusion sleeve 4. Similarly, in the secondary pressure yielding component, steel with the strength of $\sigma_2$ is selected to manufacture the second expansion platform 10. The buffering and energy-absorbing material 5 with the strength of $\sigma_2'$ is selected as the buffering and energy-absorbing material filling body of the secondary pressure yielding component. Here, $\sigma_2'$ and $\sigma_2$ are also only used for distinguishing the strengths of the selected materials, and $\sigma_2$ is greater than $\sigma_2'$.

Figure 2:
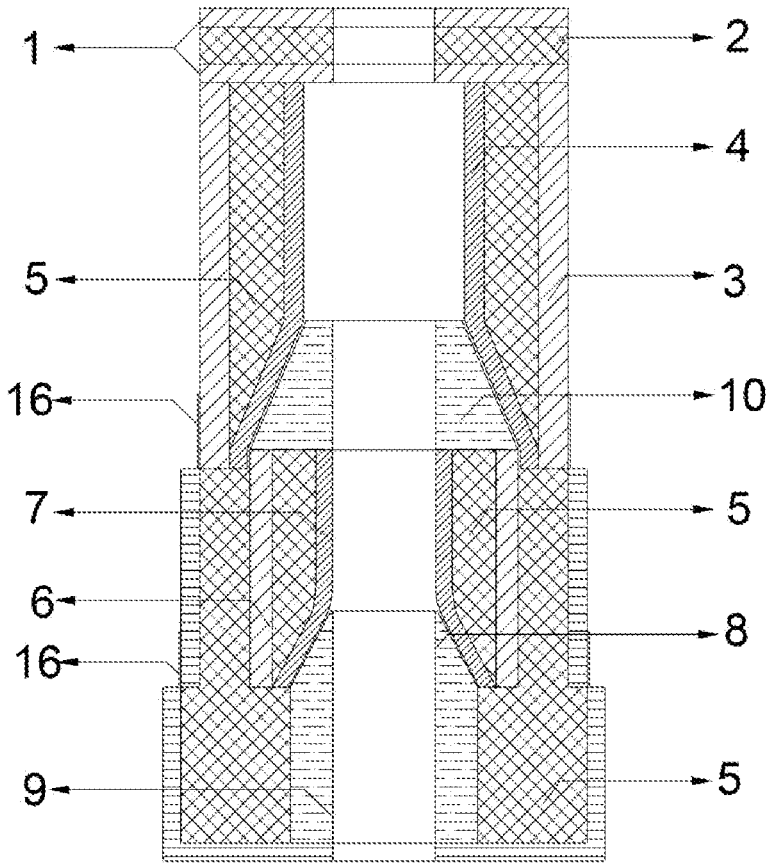
FIG. 2 is a schematic diagram of a cross-sectional structure of the multi-stage pressure yielding and anti-impact device for anchoring support disclosed in an embodiment of the present disclosure.
Figure 3:
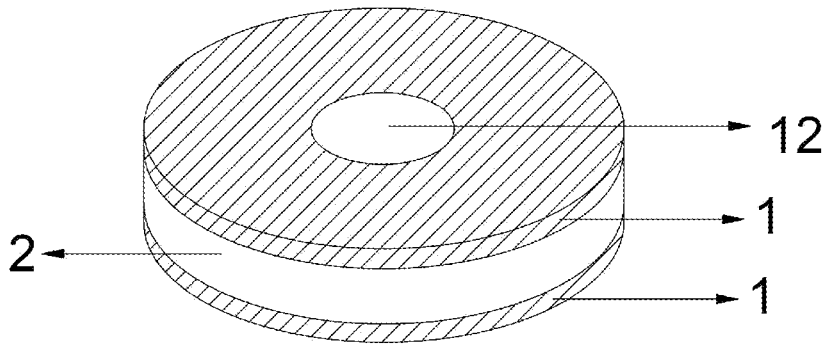
FIG. 3 is a schematic structural diagram of an anti-impact component disclosed in an embodiment of the present disclosure.
Figure 4:
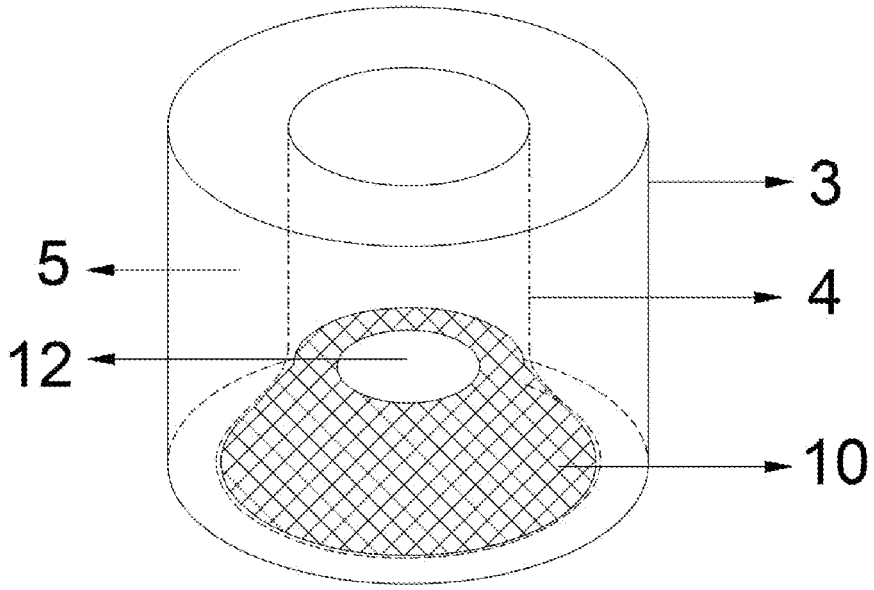
FIG. 4 is a schematic structural diagram of a secondary pressure yielding component disclosed in an embodiment of the present disclosure.
Figure 5:
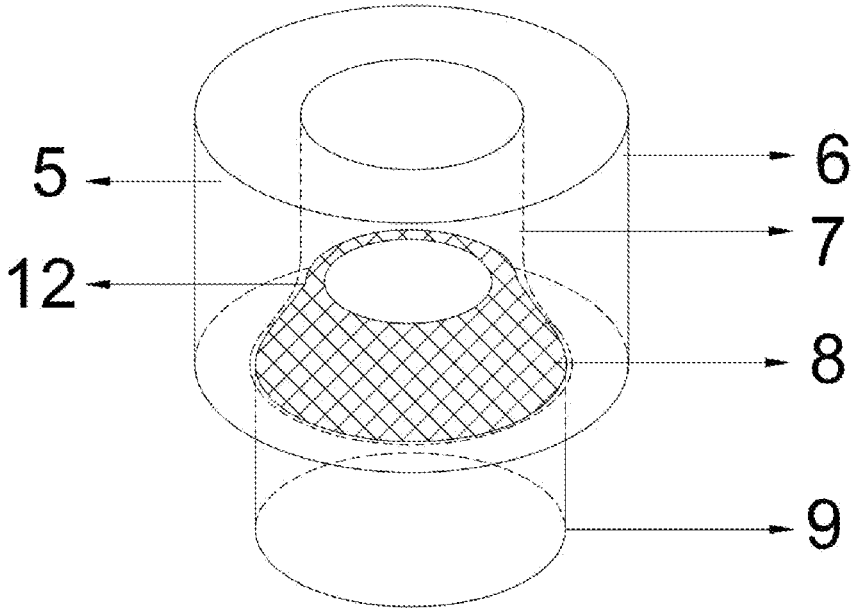
FIG. 5 is a schematic structural diagram of a primary pressure yielding component disclosed in an embodiment of the present disclosure.
Figure 6:
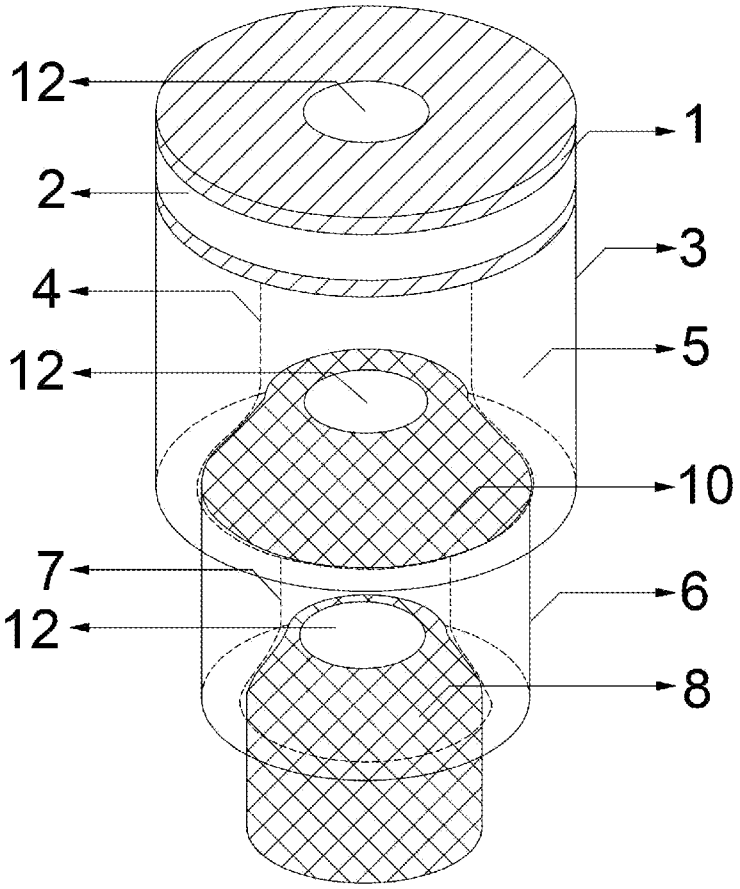
FIG. 6 is a schematic diagram of assembly of the primary pressure yielding component, the secondary pressure yielding component, and the anti-impact component disclosed in an embodiment of the present disclosure.
Figure 7:
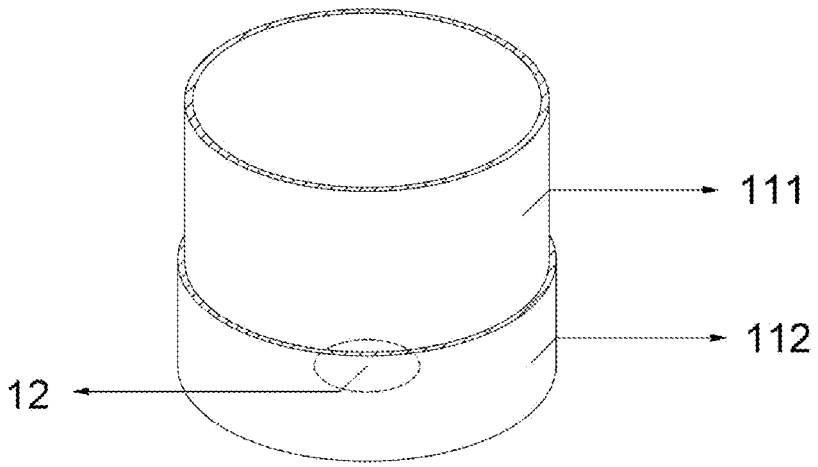
FIG. 7 is a schematic structural diagram of a telescopic cylinder disclosed in an embodiment of the present disclosure.
Figure 8:
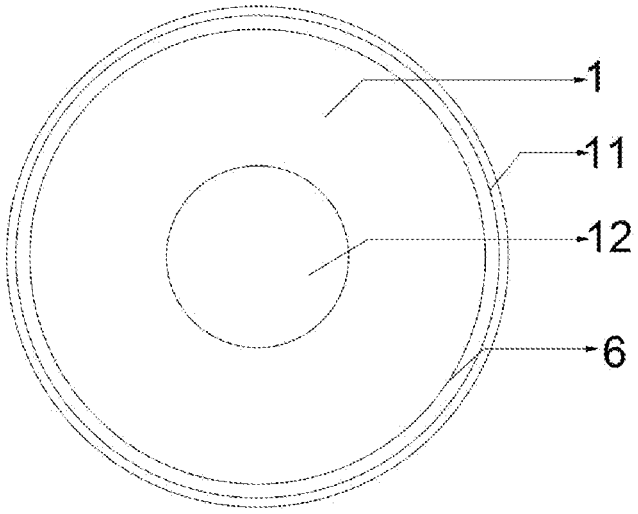
FIG. 8 is a top view of the multi-stage pressure yielding and anti-impact device for anchoring support disclosed in an embodiment of the present disclosure.
Figure 9:
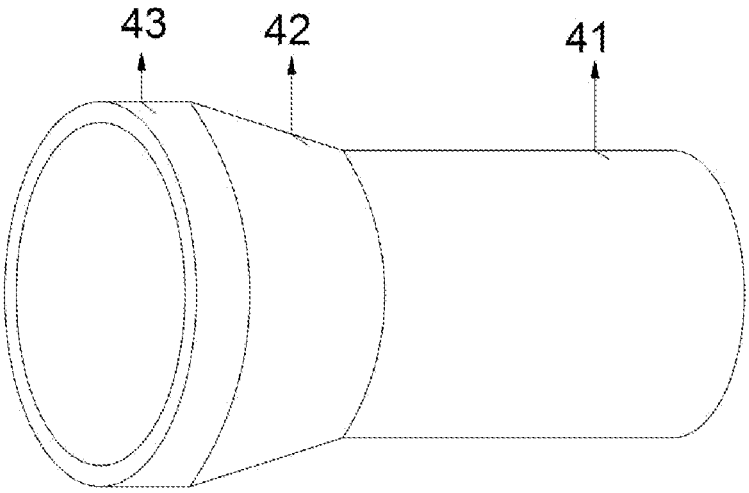
FIG. 9 is a schematic structural diagram of a second inner extrusion sleeve disclosed in an embodiment of the present disclosure.
Figure 10:
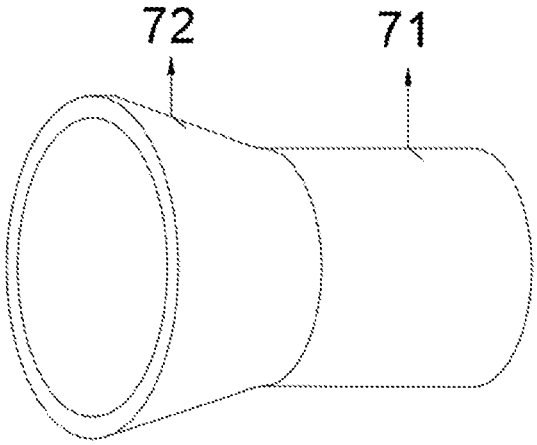
FIG. 10 is a schematic structural diagram of a first inner extrusion sleeve disclosed in an embodiment of the present disclosure.

As shown in FIG. 2, in the present embodiment, the through holes 12 for the anchor cable to pass through are concentrically formed in the axes of the secondary pressure yielding component and the primary pressure yielding component. The second expansion platform 10 and the first expansion platform 8 are positioned in the axes of the secondary pressure yielding component and the primary pressure yielding component, respectively, so that the through holes 12 are formed in both the centers of the second expansion platform 10 and the first expansion platform 8.

The anti-impact component includes two circular backing plates 1 with the same diameter as the second outer sleeve 3. The backing plate 1 has a thickness of $B_3$, and is made of a steel plate with the strength of $\sigma_3$. A top of the second outer sleeve 3 of the secondary pressure yielding component is welded with the backing plate 1, that is in contact with the second outer sleeve, in the anti-impact component, so as to form an integrated component. The buffering and energy-absorbing material plate 2 is positioned between the two backing plates 1, with the same area as that of the two backing plates 1 and a thickness of $B_3'$. Both sides of the buffering and energy-absorbing material plate are coated with glue, so that the buffering and energy-absorbing material plate is glued between the two backing plates 1 to form an integrated component. $B_3$ and $B_3'$ are only used for distinguishing different thicknesses. In order to meet the requirement of the bearing capacity $F_3$ of the anti-impact component, the buffering and energy-absorbing material plate 2 is made of the buffering and energy-absorbing material 5 with the strength of $\sigma_3'$. Similarly, $\sigma_3$ and $\sigma_3'$ are set for distinguishing the strengths of the materials. In general, $\sigma_3$ is greater than $\sigma_3'$. When a designed anti-impact bearing capacity $F_3$ is reached, the buffering and energy-absorbing material plate 2 experiences significant compression deformation and failure, thus dissipating energy and realizing impact prevention. A through hole 12 is formed in a center of an integrated component formed by the two backing plates 1 and the buffering and energy-absorbing material plate 2.

In order to prevent a component from eccentrically loading during operation, a telescopic cylinder 11 with a proper size is selected in the present disclosure. The telescopic cylinder 11 is sleeved outside the primary pressure yielding component. The telescopic cylinder 11 includes an upper telescopic cylinder 111 and a lower telescopic cylinder 112. The upper telescopic cylinder 111 is sleeved outside the first outer sleeve 6. A bottom of the upper telescopic cylinder 111 is flush with a bottom of the first outer cylinder 6. The exposed end 9 of the first expansion platform 8 extends to a bottom of the lower telescopic cylinder 112. Both the upper telescopic cylinder 111 and the lower telescopic cylinder 112 are filled with the buffering and energy-absorbing material 5. In order to ensure the stability of the telescopic cylinder 11 during the process of pressure yielding, the upper telescopic cylinder and the lower telescopic cylinder are made of the same material as the second outer sleeve 3 and the first outer sleeve 6, respectively. During the process of pressure yielding through the device, the telescopic cylinder 11 also expands and contracts to the same extent as the outer sleeves. In this process, the buffering and energy-absorbing materials filled in the upper telescopic cylinder 111 and the lower telescopic cylinder 112 are also compressed and absorb energy.

High-strength closed-cell foam aluminum can be selected as the buffering and energy-absorbing material 5 filled in each of the above components, which has high specific stiffness, specific strength, long compression stroke, and good energy absorption, thus it is a high-quality energy absorption material. Under the action of force, the high-strength closed-cell foam aluminum absorbs a lot of energy through deformation. It should be noted that, the above components have different bearing capacities, so that the buffering and energy-absorbing materials 5 with different strengths (but ensure that the strength of the buffering and energy-absorbing material 5 matches the strength of the corresponding component) may be selected for filling according to actual needs.

In this embodiment, the above multi-level pressure yielding and ant-impact device for anchoring support further includes pressure yielding identification marks. The pressure yielding identification marks are painted axially at bottoms of outer walls of the upper telescopic cylinder 111 and the second outer sleeve 3 with paints of different colors. The marks are divided into different types according to colors of selected paints. Taking two types of marks as an example, an upper mark is painted with red paint, and a lower mark is painted with green paint. When the device is installed in an initial stage, both the red mark and the green mark of the pressure yielding identification marks 16 on the upper telescopic cylinder 111 and the second outer sleeve 3 are visible. When a pressure yielding is carried out by the device, the upper telescopic cylinder 111 and the lower telescopic cylinder 112 move relative to each other, the pressure yielding identification marks 16 on the upper telescopic cylinder 111 and the second outer sleeve 3 are partially or completely covered, respectively. By observing and comparing the difference in colors of the pressure yielding identification marks between the initial state and working state of the device, a pressure yielding condition of the device is determined, and thus a loading range of a support body is determined. Specifically, once the red mark of the pressure yielding identification marks 16 on the upper telescopic cylinder 111 disappears (the red mark is covered by the lower telescopic cylinder 112), and only the green mark is visible, or both the red mark and the green mark disappear (both the red mark and the green mark are covered by the lower telescopic cylinder 112), the device is in a primary pressure yielding state. Similarly, once the red mark of the pressure yielding identification marks 16 on the second outer sleeve 3 disappears (the red mark is covered by the upper telescopic cylinder 111), and only the green mark is visible, or both the red mark and the green mark disappear (both the red mark and the green mark are covered by the upper telescopic cylinder 111), the device is in a secondary pressure yielding state. In order to facilitate observing, preferably, different marks are painted with prominent colors such as yellow, green, and red for identifying. An axial length of each mark is adjusted according to characteristics of different on-site engineering projects and pressure yielding designs. It is generally recommended that the axial length of each mark is 3 mm~5 mm.

Figure 11:
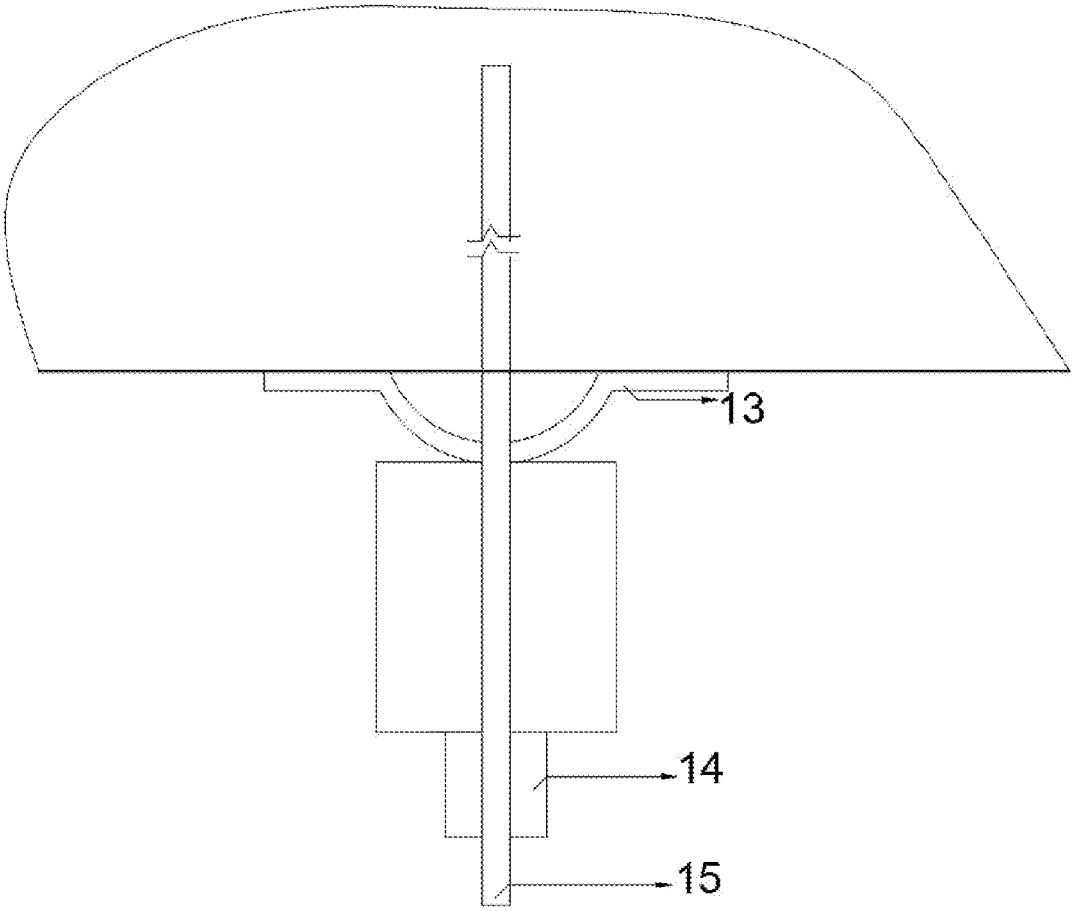
FIG. 11 is a schematic diagram of application of an entire support body to a roof in an embodiment of the present disclosure.

When the multi-stage pressure yielding and anti-impact device in this embodiment is adapted to the anchor cable 15, in order to enable the multi-stage pressure yielding and anti-impact device more stable during operation, the device is installed upside down. After the excavation of the roadway is finished, the anchor cable 15 is anchored, the multi-stage pressure yielding and anti-impact device is installed, and an installed state is as shown in FIG. 11. When the force acting on the device by the deformation of the surrounding rock is less than the designed bearing capacity of the device, the deformation of the surrounding rock is controlled through the elastic deformation of a steel strand of the anchor cable. When the stress acting on the surrounding rock is greater than the bearing capacity $F_1$ of the primary pressure yielding component, the first expansion platform 8 in the primary pressure yielding component slides to carry out a primary pressure yielding, releasing the stress of the surrounding rock and effectively controlling the deformation of the surrounding rock. Under the compression of the first expansion platform 8, the expansion part of the second inner extrusion sleeve 4 expands, the buffering and energy-absorbing material is continuously compressed by the expanding first inner extrusion sleeve 7 to absorb energy and release pressure, and some energy can also be absorbed through sliding friction produced between the first expansion platform 8 and the first inner extrusion sleeve 7. With the continuous increase of pressure, the first expansion platform 8 continuously moves in the first inner extrusion sleeve 7 until the first expansion platform 8 is completely pressed onto the top of the first inner extrusion sleeve 7. At this moment, the primary pressure yielding component is formed as a solid whole, and the primary pressure yielding is finished. The solid whole of the completely compressed primary pressure yielding component is taken as a transmission part of force. When the stress acting on the surrounding rock is greater than the bearing capacity $F_2$ of the secondary pressure yielding component, the solid whole transfers the load to the second expansion platform 10 in the secondary pressure yielding component. A secondary pressure yielding is carried out by the anchor cable 15, and the working principle and changes the components during operation of the secondary pressure yielding are the same as those of the primary pressure yielding. During the process of the primary pressure yielding and secondary pressure yielding, the buffering and energy-absorbing material plate 2 in the anti-impact component experiences slight compression deformation under force. When impact disturbance load is greater than the bearing capacity $F_3$ of the anti-impact component, the buffering and energy-absorbing material plate 2 experiences significant compression deformation and failure, thus dissipating energy and realizing impact prevention.

The applicant declares that detailed methods of the present disclosure are described in the present disclosure through the above examples, but the present disclosure is not limited to the above detailed methods, which does not mean that the present disclosure must rely on the above detailed methods for implementation. Those skilled in the art are to be aware that any improvements to the present disclosure, equivalent transformations of raw materials and addition of auxiliary components, as well as the selection of specific conditions and methods of the present disclosure all fall within the scope of protection and disclosure of the present disclosure.

What is claimed is:

1. A multi-stage pressure yielding and anti-impact device for anchoring support, applied to an anchor cable or an anchor bolt, comprising an anti-impact component, a secondary pressure yielding component, and a primary pressure yielding component, the primary pressure yielding component, the secondary pressure yielding component, and the anti-impact component work in sequence; a relationship among a bearing capacity $F_1$ of the primary pressure yielding component, a bearing capacity $F_2$ of the secondary pressure yielding component, and a bearing capacity $F_3$ of the anti-impact component is $F_3>F_2>F_1$; the anti-impact component, the secondary pressure yielding component, and the primary pressure yielding component are arranged in sequence from top to bottom; through holes for the anchor bolt and the anchor cable to pass through is concentrically formed in axes of the anti-impact component, the secondary pressure yielding component, and the primary pressure yielding component, respectively;

the primary pressure yielding component and the secondary pressure yielding component each comprise an outer sleeve, an inner extrusion sleeve, and an expansion platform, and the expansion platform is arranged at a bottom end of the inner extrusion sleeve; a buffering and energy-absorbing material filling body is arranged between the outer sleeve and the inner extrusion sleeve; an outside diameter of the outer sleeve in the primary pressure yielding component is equal to that of a large-diameter end of the expansion platform in the secondary pressure yielding component, and the outer sleeve in the primary pressure yielding component is pressed against a bottom of the expansion platform in the secondary pressure yielding component; and the anti-impact component matches the outer sleeve of the secondary pressure yielding component in diameter, and the anti-impact component is welded with the secondary pressure yielding component to form an integrated component.

2. The multi-stage pressure yielding and anti-impact device for anchoring support according to claim 1, wherein the primary pressure yielding component comprises a first outer sleeve of a cylindrical hollow structure; a first inner extrusion sleeve with an equal length to that of the first outer sleeve arranged on an inner side of the first outer sleeve; a buffering and energy-absorbing material filled between the first outer sleeve and the first inner extrusion sleeve; the first inner extrusion sleeve in the first outer sleeve comprises a first expansion part, an arc-shaped connection structure, and a first in-situ part from top to bottom; the first in-situ part is of a circular truncated cone-shaped hollow structure; the arc-shaped connection structure is configured to connect the first expansion part with the first in-situ part; the first expansion part is of a cylindrical hollow structure with an inner diameter equal to a diameter of the anchor cable;

a first expansion platform is installed on the first in-situ part of the first inner extrusion sleeve; a diameter of the first expansion part is equal to a diameter of a small-diameter end of the first expansion platform; the first expansion platform comprises a cylindrical exposed end extending out of the first inner extrusion sleeve; and the exposed end is capable of pushing the first expansion platform to slide in the first inner extrusion sleeve under force.

3. The multi-stage pressure yielding and anti-impact device for anchoring support according to claim 2, wherein the secondary pressure yielding component comprises a second outer sleeve of a cylindrical hollow structure; a second inner extrusion sleeve with an equal length to that of the second outer sleeve arranged on an inner side of the second outer sleeve; a buffering and energy-absorbing material filled between the second outer sleeve and the second inner extrusion sleeve; the second inner extrusion sleeve in the second outer sleeve comprises a second expansion part, an arc-shaped connection structure, a second in-situ part, and an extended end from top to bottom; the second expansion part is of a cylindrical hollow structure with an inner diameter configured for allowing the anchor bolt and the anchor cable to pass through; the second in-situ part is of a circular truncated cone-shaped hollow structure; the arc-shaped connection structure is configured to connect the second expansion part with the second in-situ part; a second expansion platform matching the second in-situ part in shape is installed on the second in-situ part of the second inner extrusion sleeve; and a top of the first outer sleeve extends into the second inner extrusion sleeve and is connected with the second inner extrusion sleeve.

4. The multi-stage pressure yielding and anti-impact device for anchoring support according to claim 3, wherein the anti-impact component comprises two circular backing plates with a diameter equal to that of the second outer sleeve; a buffering and energy-absorbing material plate is glued between the two backing plates; the second outer sleeve is welded with a lower backing plate; and a through hole for the anchor bolt and the anchor cable to pass through is formed in a center of an integrated component formed by the two backing plates and the buffering and energy-absorbing material plate.

5. The multi-stage pressure yielding and anti-impact device for anchoring support according to claim 4, further comprising a telescopic cylinder sleeved outside the primary pressure yielding component, the telescopic cylinder comprises an upper telescopic cylinder and a lower telescopic cylinder; the upper telescopic cylinder is sleeved outside the first outer sleeve; a bottom of the upper telescopic cylinder is flush with a bottom of the first outer cylinder; and the exposed end of the first expansion platform extends to a bottom of the lower telescopic cylinder.

6. The multi-stage pressure yielding and anti-impact device for anchoring support according to claim 5, wherein the buffering and energy-absorbing material is filled inside both the upper telescopic cylinder and the lower telescopic cylinder.

7. The multi-stage pressure yielding and anti-impact device for anchoring support according to claim 6, further comprising pressure yielding identification marks, the pressure yielding identification marks are painted axially at bottoms of outer walls of the upper telescopic cylinder and the lower telescopic cylinder with paints of different colors, and the marks are divided into different types according to colors of selected paints.

8. The multi-stage pressure yielding and anti-impact device for anchoring support according to claim 7, wherein an axial length of any of the marks is 3 mm to 5 mm.

9. The multi-stage pressure yielding and anti-impact device for anchoring support according to claim 3, further comprising a telescopic cylinder sleeved outside the primary pressure yielding component, the telescopic cylinder comprises an upper telescopic cylinder and a lower telescopic cylinder; the upper telescopic cylinder is sleeved outside the first outer sleeve; a bottom of the upper telescopic cylinder is flush with a bottom of the first outer cylinder; and the exposed end of the first expansion platform extends to a bottom of the lower telescopic cylinder.

10. The multi-stage pressure yielding and anti-impact device for anchoring support according to claim 9, wherein the buffering and energy-absorbing material is filled inside both the upper telescopic cylinder and the lower telescopic cylinder.

11. The multi-stage pressure yielding and anti-impact device for anchoring support according to claim 10, further comprising pressure yielding identification marks, the pressure yielding identification marks are painted axially at bottoms of outer walls of the upper telescopic cylinder and the lower telescopic cylinder with paints of different colors, and the marks are divided into different types according to colors of selected paints.

12. The multi-stage pressure yielding and anti-impact device for anchoring support according to claim 11, wherein an axial length of any of the marks is 3 mm to 5 mm.

* * * * *